US006702642B1

(12) United States Patent
Parein

(10) Patent No.: US 6,702,642 B1
(45) Date of Patent: Mar. 9, 2004

(54) BODY FOR USE IN A TOY SET

(76) Inventor: Eric Parein, Boomsesteenweg 259, bus 8, 2020 Antwerp (BE)

( * ) Notice: Subject to any disclaimer, the term of this patent is extended or adjusted under 35 U.S.C. 154(b) by 0 days.

(21) Appl. No.: 09/646,966

(22) PCT Filed: Mar. 22, 1999

(86) PCT No.: PCT/BE99/00039

§ 371 (c)(1),
(2), (4) Date: Sep. 25, 2000

(87) PCT Pub. No.: WO99/48582

PCT Pub. Date: Sep. 30, 1999

(30) Foreign Application Priority Data

Mar. 26, 1998 (WO) ..... PCT/BE98/00043

(51) Int. Cl.[7] ..... A63H 33/08; A63H 33/06

(52) U.S. Cl. ..... 446/105; 446/120; 446/125

(58) Field of Search ..... 446/75, 85, 89, 446/102, 105, 117, 119, 120, 121, 122, 124, 125, 127, 104, 106, 128

(56) References Cited

U.S. PATENT DOCUMENTS 4,606,732 A * 8/1986 Lyman ..... 446/104
4,764,143 A * 8/1988 Gat et al. ..... 446/102
4,968,040 A * 11/1990 McElhaney ..... 273/290
5,172,534 A * 12/1992 Milner et al. ..... 446/104
5,259,803 A * 11/1993 Lyman ..... 446/103
5,361,919 A 11/1994 Hull et al.
5,402,903 A * 4/1995 Mann ..... 220/23.6
5,795,210 A * 8/1998 Kushner et al. ..... 446/117
5,848,927 A * 12/1998 Frederiksen ..... 446/124
6,050,044 A * 4/2000 McIntosh ..... 446/124
6,086,444 A * 7/2000 Glickman ..... 446/120
6,200,187 B1 * 3/2001 Olsen et al. ..... 446/120
6,250,986 B1 * 6/2001 Sorensen ..... 446/121
6,296,541 B1 * 10/2001 Bezalel et al. ..... 446/105
6,325,694 B1 * 12/2001 Clever et al. ..... 403/165

FOREIGN PATENT DOCUMENTS

DE 1 607 861 2/1970

OTHER PUBLICATIONS

PCT International publication No.: WO 93/22018, International publication date Nov. 11, 1993.*

* cited by examiner

*Primary Examiner*—Derris H. Banks
*Assistant Examiner*—Faye Francis
(74) *Attorney, Agent, or Firm*—Sughrue Mion, PLLC

(57) ABSTRACT

The present invention relates to a toy set comprising at least a first, second, third and fourth body provided to be mated adjacent each other and on top of each other, enabling to build a construction wherein a number of configurations of bodies with respect to each other is rendered possible. The present invention further relates to a body for use in a toy set and use of the body as a cap of a recipient or as a recipient.

22 Claims, 6 Drawing Sheets

BODY FOR USE IN A TOY SET

The present invention relates to a toy set comprising at least a first, second, third and fourth body, each body being substantially equally dimensioned, wherein:

- each of said bodies comprises a coupling portion applied on a base portion,
- each base portion has an outer surface delimiting a substantially cylindrical shaped cavity,
- said first and second bodies are provided for being stacked upon each other, wherein said coupling portion of said first body rotatably fits within said cavity of said second body,
- said third and fourth bodies are provided for being stacked upon each other, wherein said coupling portion of said third body rotatably fits within said cavity of said fourth body,
- each of said bodies further comprises at least a connecting member, wherein at least one of said connecting members forms a protrusion extending outwardly from said outer surface,
- said first and third bodies are provided for being assembled adjacent each other, wherein said connecting member of said first body fits within said connecting member of said third body, and
- said second and fourth bodies are provided for being assembled adjacent each other, wherein said connecting member of said second body fits within said connecting member of said fourth body.

Such a toy set is known from U.S. Pat. No. 5,361,919. In this toy set, the bodies have the same shape and may be used as a bottle cap as well as a toy. The coupling portion is formed by a circular protrusion provided on the base portion having the shape of a hollow polygon, in particular a hexagon. When two bodies are stacked on top of each other, the circular protrusion of one of the bodies rotatably fits into the cavity of the other body. Each body further comprises, on each external surface of the polygon, a detent extending from the surface or an indent provided in the surface, the detent extending from a surface of one body being provided for being fitted within an indent of a surface from another body. In this way, two bodies may be fitted adjacent each other wherein said surface with the detent from the one body is tangent to the surface with the indent from the other body.

FIG. 1 illustrates schematically a construction performed with known bodies. Referring to FIG. 1, when four of these known bodies are used, it is possible to fit them in such a manner that a second body 2 is stacked on a first body 1 and a third body 3 is assembled to said first body by mating a detent 5 on the first body with an indent 6 on the third body. If it is desired to stack the fourth body 4 on top of the third body 3 without assembling the fourth body 4 to the second body 2, care should be taken that the two tangent surfaces both comprise an indent 7, 8 so as to avoid mating of the fourth and second body. This limits the number of possible configurations of the bodies. In particular, if the bodies have an outer surface in the shape of an hexagon, wherein detents are provided every two sides, such as disclosed in U.S. Pat. No. 5,361,919, only three configurations of the second body are allowed, i.e. when the indents of the second body are adjacent an indent on the fourth body. In addition, stepwise rotation will be obstructed by one of the detents (not shown) provided on the surfaces of the second or fourth body.

The object of the present invention is to provide a toy set enabling to build a construction wherein a first pair of bodies are assembled adjacent each other by mating the connecting members and two further bodies may each be provided adjacent one each other on top of said pair in such a manner that a large number of configurations are possible.

It is a further object that at least a stepwise rotation of the further bodies with respect to each other, preferably over an angle of at least 180 degrees is rendered possible.

According to one aspect of the present invention, the toy set is characterised in that:

- each protrusion of said first and third bodies is only located within a space delimited, when said first and third bodies are assembled adjacent each other, by said outer surfaces of the first and third bodies and two common tangent planes, each of said common tangent planes being tangent to both of said outer surfaces of said first and third bodies, and
- each protrusion of said second and fourth bodies is only located within a space delimited, when said second and fourth bodies are assembled adjacent each other, between said outer surfaces of the second and fourth bodies and between two common tangent planes, each of said common tangent planes being tangent to both of said outer surfaces of said second and fourth bodies.

It is possible to build a construction wherein a first pair of bodies, for example the first and third bodies (or the second and fourth bodies), are mated adjacent each other, and two further bodies, for example the second and fourth bodies (or the first and third bodies), are provided adjacent each other on top of said pair without mating connecting members of the two further bodies to each other. By providing that each protrusion is only located within the defined limited space, different configurations of the further bodies without mating the further bodies to each other are possible. For example, if the base portion of the bodies has a squared outer surface, three configurations of one of the further bodies is allowed without having to mate the second and fourth body with each other. In case of a hexagon, where protrusions are provided on one of the sides, five configurations are possible.

In particular, said outer surface is substantially polygonal at least outside said space and comprises at least three sides outside said space. This allows an at least stepwise rotation movement, in particular of at least 180 degrees without being obstructed by a protrusion.

In a first preferred embodiment of the toy set according to the invention, each connecting member comprises a male member and a female member; in each connecting member at least one of said male and female members from said protrusion extends outwardly from said outer surface; and when two of said bodies are assembled adjacent each other, said male member from one of the bodies is provided for mating within said female member of the other body and said female member of the one body is provided for mating within said male member of the other body.

This enables to mate two bodies adjacent each other without requiring two different types of bodies, i.e. female bodies and male bodies, since both bodies have a connecting member formed by a male member and a female member. When two bodies of this type are assembled adjacent each other, both the male and female members of the one body are connected to the female and male member of the other body.

In a second preferred embodiment of the toy set according to the invention, both said male and female members form said protrusion extending outwardly from said outer surface and said male and female members of one of the bodies are provided for being slidably mated with said female and male members of another of said bodies. When two such bodies are mated adjacent each other, a tight connection of the two bodies is ensured. It will be difficult to disengage such a connection by pulling the two bodies apart from each other. The two bodies may easily be disengaged from each other by sliding them apart from each other.

In a third preferred embodiment of the toy set according to the invention, said male and female members are located on said outer surface within a segment not larger than 60 degrees of said outer surface. In this way, when a construction as set hereinabove is built, at least a stepwise rotation movement of relatively more than 180 degrees will be possible without being obstructed by a male or female member.

In a fourth preferred embodiment of the toy set according to the invention, said male and female members are located on said outer surface on a segment of at least 40 degrees of said outer surface. This guarantees that the male and female member are sufficiently spaced apart from each other, so that torsion of two such bodies mated adjacent each other is limited and a tight connection is ensured.

The present invention also relates to a body for use in a toy set and use of the body as a cap for a recipient, a recipient or a building block.

The invention will now be described further in detail referring to the annexed drawings, wherein.

Figure 20A:
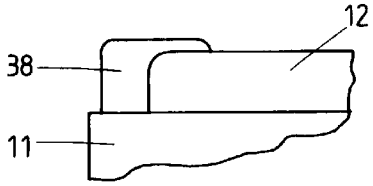
Figure 20B:
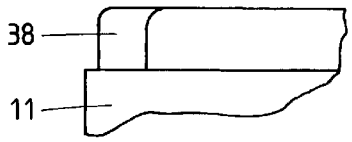
Figure 20C:
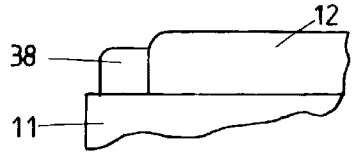

FIGS. 20*a* and 20*b* and 20*c* illustrate several configurations of the clamping member in a body according to the invention.

Figure 21:
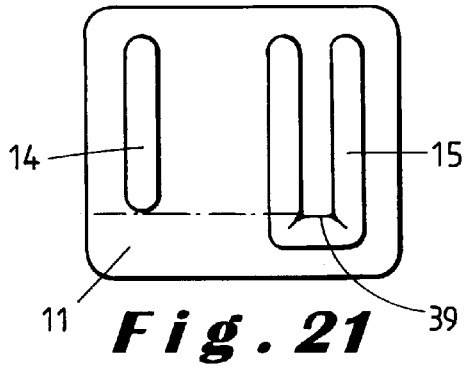
Figure 22:
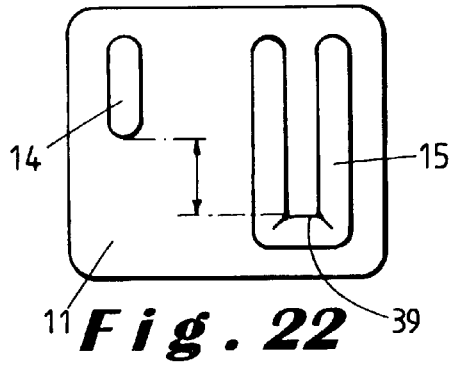

FIGS. 21 and 22 are side views on two embodiments of the base portion having male and female members with a stopping member.

Figure 23:
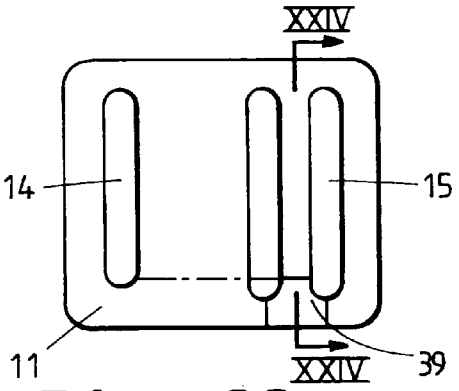

FIG. 23 is a side view on a further embodiment of the base portion having male and female members with a stopping member.

Figure 24:
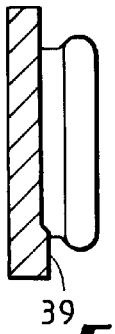

FIG. 24 is a cross section according to line XXIV—XXIV in FIG. 23.

Figure 25:
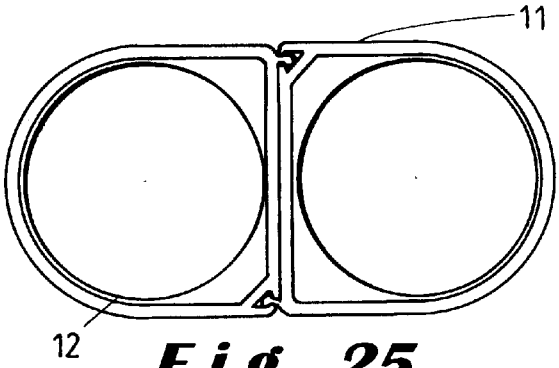
Figure 26:
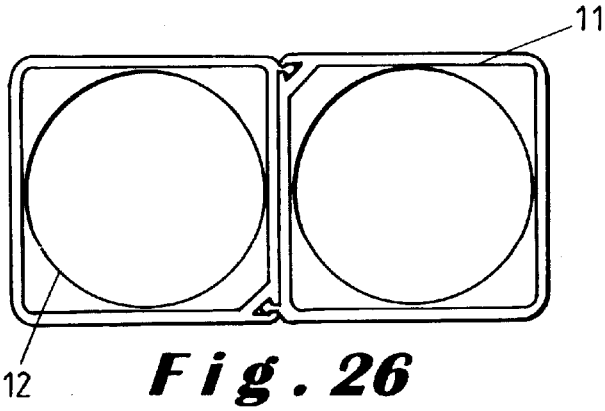

FIGS. 25 and 26 are top views on bodies according to further embodiments of the invention.

Figure 1:
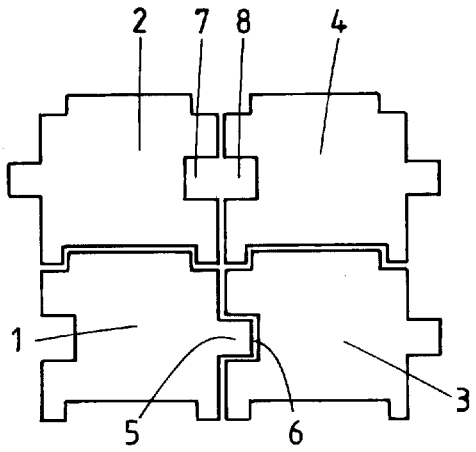
Fig. 1 (PRIOR ART)
FIG. 1 illustrates in cross section a construction performed with a toy set according to the prior art.
Figure 2:
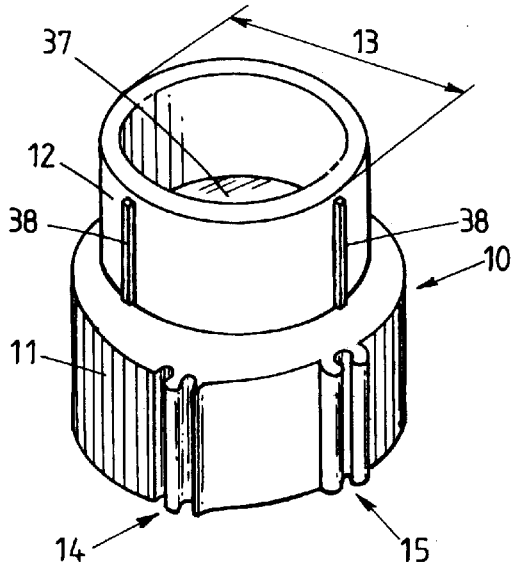
FIG. 2 shows, on an enlarged scale, a perspective view of a body according to the invention.
Figure 27:
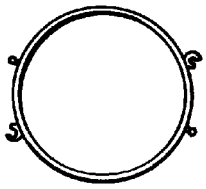

FIG. 27 is a top view on a connection body provided for being mated between two bodies according to FIG. 2.

Figure 28:
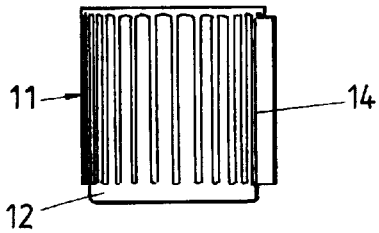
Figure 29:
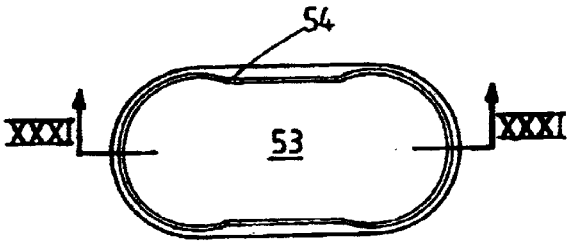

FIG. 28 is a side view on a further body according to the invention.

FIGS. 29 to 32 show a double shaped toy set or building block according to the invention.

Figure 33:
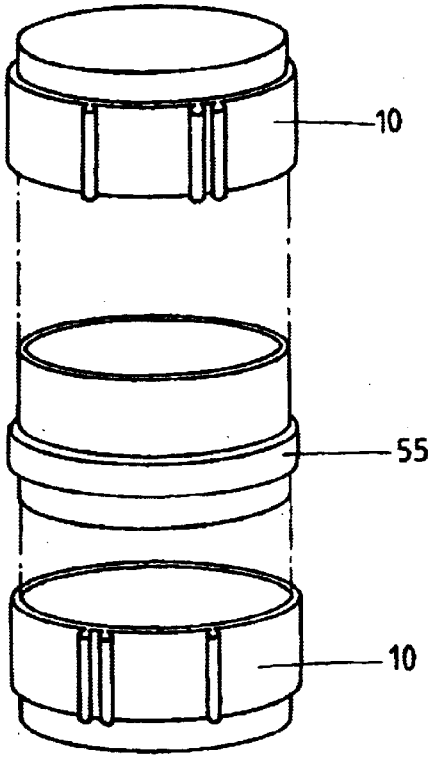
Figure 34:
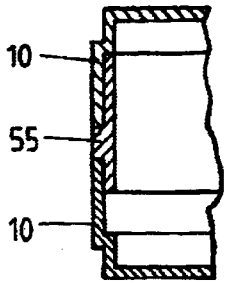

FIGS. 33 and 34 show a coupling ring mounted on a body according to the invention.

Referring to FIG. 2, there is shown a body 10 according to a preferred embodiment of the invention. The body 10 is formed by a base portion 11 having a substantially polygonal outer surface, in particular cylindrical, and comprising a cavity (not shown) of a substantially cylindrical shape. On the base portion 11, a coupling portion 12 is applied. The base portion is thus hollow, whereas the coupling portion may be a hollow piece or a plain piece of material. According to a preferred embodiment, the coupling portion is hollow, so that upon moulding such a body in a plastic material, the overall thickness of the body is kept as low as possible. In this manner "hot spots" are avoided as much as possible.

The coupling portion is dimensioned in such a manner that it enables a rotation movement when it is fitted within the cavity of the base portion of another body. In particular, the coupling portion has a substantially cylindrical shape with an external diameter 13 essentially equal to the internal diameter (not shown) of the cavity.

The body 10 further comprises a connection member 14, 15 provided on the base portion. In particular, the connection member is formed by a male member 14 and a female member 15. According to an alternative embodiment, the connection member could be formed by only a male member which is provided to be fitted in a corresponding female member of another body. The connection member may be formed by protrusions extending outwardly from the outer surface of the base portion, but could also form an excavation in one body provided to fit within a protrusion of another body.

Two bodies according to the invention may thus be stacked upon each other by fitting the coupling portion of a first body into the cavity in the base portion of a second body.

Figure 3:
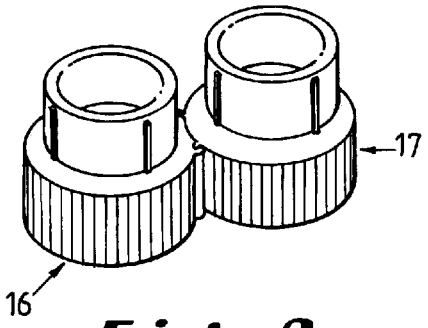
FIG. 3 is a perspective view of two bodies according to FIG. 2 when assembled adjacent each other.

Two bodies according to the invention may also be assembled adjacent each other by engaging the connection member of a first body into the connection member of a second body, as shown in FIG. 3. Such a construction is called a "brick" hereinafter.

Figure 4:
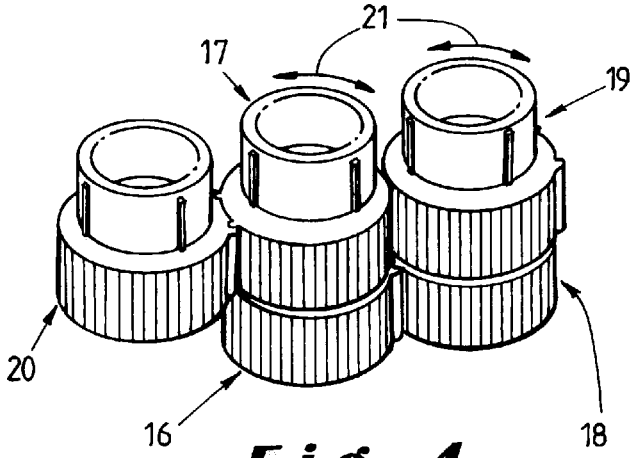
FIG. 4 is a perspective view of a construction performed with several bodies according to FIG. 2.

FIG. 4 illustrates a further construction with a plurality of bodies according to the invention. It may for example be assembled as follows. A second body 17 is stacked on a first body 16 as explained hereinabove. Then, a third body 18 is assembled adjacent said first body as explained in connection with FIG. 3. A fourth body 19 is then stacked on the third body 18 and optionally, a fifth body 20 may be assembled adjacent the second body 17 by engaging the male and female members of the fifth body into the female and male members of the second body. As indicated by the arrows 21, both bricks 17, 20 and the fourth body 19 may be rotated over an angle of at least 180 degrees, since the shape of the outer surface of the respective base portions is substantially cylindrical and thanks to the absence of protruding parts in the movement.

Figure 5:
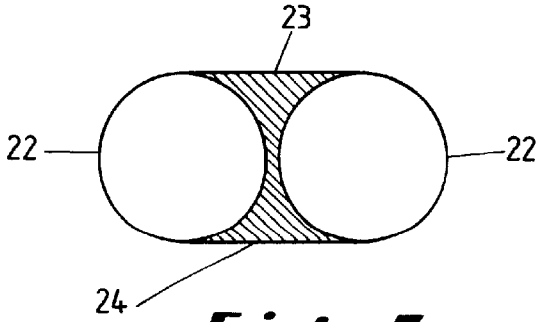
FIG. 5 illustrates schematically the space wherein the protrusions are located.

FIG. 5 illustrates a simplified bottom view of the outer surfaces 22 of the base portion of two bodies according to FIG. 3 mated adjacent each other. As described hereinabove, the base portion has a substantially polygonal outer surface, in particular cylindrical. The particular cylindrical shape is illustrated in FIG. 5, but the same reasoning could be applied if the shape is different such as for example the shape illustrated in FIG. 14. In FIG. 5, the male and female members have been omitted for the sake of clarity of the following explanation. The two circles 22 corresponding to the outer surface do not touch each other in this Figure.

According to an alternative, the two outer surfaces touch each other so as to provide a tighter structure when the two bodies are assembled adjacent each other. The hatched part of FIG. 5 indicates the space within which the protrusions must be located in order to enable the described rotation movement of at least 180 degrees. This space is delimited between the outer surfaces 22 and the two common tangent planes 23 and 24. The two common tangent planes are tangent to both outer surfaces 22 of the first and second body.

Figure 6:
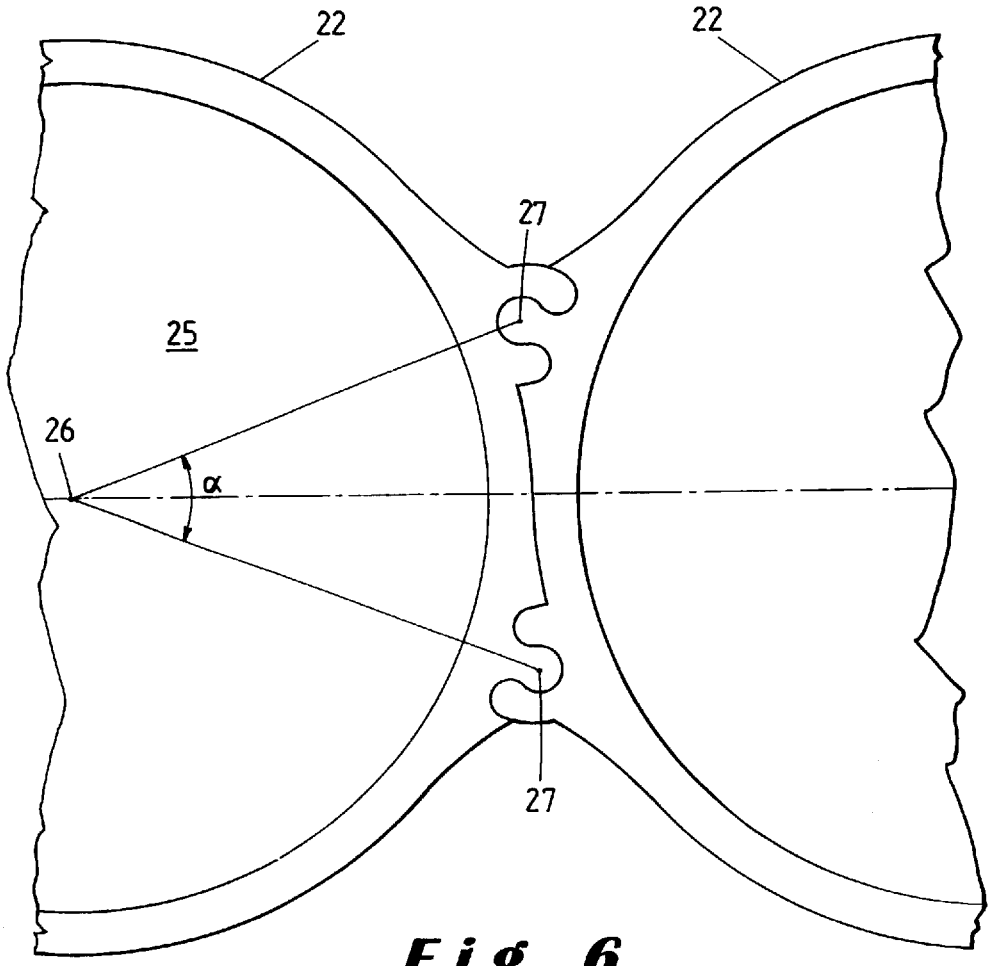
FIG. 6 shows a detail of the male and female members according to a preferred embodiment.

FIG. 6 shows a detailed view of the male and female members of a first body when assembled with a female and a male member of a second body as illustrated in FIG. 3. According to this preferred embodiment, both the male members 14 and the female members 15 form protrusions extending outwardly from the outer surface 22 of the base portion. In addition, the male and female members are shaped in such a manner that they are to be mated to each other by sliding the male member within the female member according to a direction essentially parallel to the central axis 26 of the base portion. An advantage of this preferred embodiment is that two bodies, when assembled adjacent each other by mating the connection members to each other, are tightly connected to each other and a relatively high force will be required for pulling the two bodies apart from each other.

The shapes of the male and female members also determine the degree of tightness of the assemblage. It has been found that female members 15 which are substantially C-shaped and male members 14 having a corresponding complementary shape, as illustrated in FIG. 6, contribute advantageously to the degree of tightness of the assemblage.

FIGS. 21 to 24 show other embodiments of male and female members, wherein the female member 15 is provided with a stopping member 39 provided for avoiding or limiting sliding of two assembled bodies with respect to each other. Assembling two bodies according to these embodiments occurs by pressing them together instead of sliding them one into another. For this purpose, at least the female members should have a sufficient degree of elasticity. The male member could have the same length as the female members without the stopping member as illustrated in FIG. 21. When two bodies according to this embodiment are mated to each other, a sliding movement is hindered by the stopping members provided on each of the female members. With the embodiment of FIG. 22, a sliding movement is still allowed since the male member 14 has a shorter length than the female member, but two assembled bodies can not be disassembled by a sliding movement. The shorter length of male member 14 determines the distance of the sliding movement.

FIGS. 23 and 24 show an alternative of the stopping member 39. According to this embodiment, the stopping member protrudes from the base portion 11 of the body, as clearly illustrated in FIG. 24, in such a manner that two bodies can slide with respect to each other when a determined force is applied. Thus, according to this embodiment, sliding is hampered by the stopping member but is still possible when applying sufficient force, which is advantageous for assembling and disassembling the bodies.

It should be noted that these stopping members are not limited to be applied on bodies according to the present invention comprising both a coupling portion and a base portion, but could also be provided on any type of bodies provided to be assembled to each other.

Spacing of the male and female members also determines the degree of rigidity of the assemblage. The more the male 14 and female 15 members are spaced apart from each other, the more rigid will be the connection. It has been found that when said male and female members are spaced according to an angle $\alpha$ of at least 40 degrees, a relatively rigid connection is ensured.

The angle $\alpha$ is defined as the angle formed by the central axis 27 of the two male members 14 with respect to the central axis 26 of the base portion.

On the other hand, the smaller the angle $\alpha$, the larger the angle of rotation of the described rotation movement will be. It has been found that the angle should preferably not exceed a maximum value of 60 degrees, so as to ensure a rotation movement of more than 180 degrees. Thus a compromise must be found between an angle which is large enough for ensuring a tight connection, but not too large for enabling a rotation movement larger than 180 degrees. If it is desired to limit the rotation movement to approximately 180 degrees, then the angle $\alpha$ should be as large as possible, as long as the protrusions, i.e. the male and/or the female members, are located within the defined space.

In order to limit hot spots as much as possible, the thickness of the entire body should be kept limited. In a preferred embodiment, the thickness of the body, except in the neighbourhood of the connecting members, should not exceed 2 mm and in particular 1 mm. In the neighbourhood of the male and female members, the thickness should preferably not exceed 3 mm.

Figure 7:
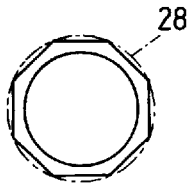
FIGS. 7 to 13 show a number of alternatives for the shape of the coupling portion of the body according to the invention.
Figure 8:
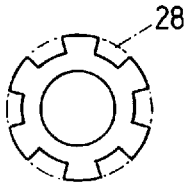
Figure 9:
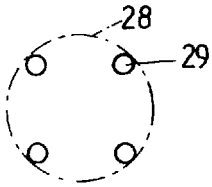
Figure 10:
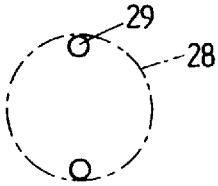
Figure 11:
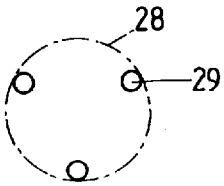
Figure 12:
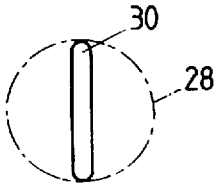
Figure 13:
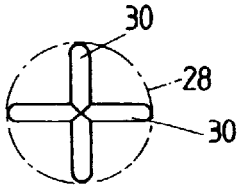

In the preferred embodiment of the body 10 according to FIG. 2, the coupling portion 12 has a substantially cylindrical shape, which is preferably hollow for keeping the thickness of the body as limited as possible. The coupling portions could have other shapes such as for example illustrated in FIGS. 7 to 13. Care should be taken that the coupling portion of a body 10 rotatably fits within the substantially cylindrical cavity 25 (FIG. 6) of the base portion of another body 10. For this reason, the shape of the coupling portion is delimited within a virtual or imaginary cylinder 28 having a diameter essentially equal to said substantially cylindrical shaped cavity 25. As illustrated in FIG. 7, the coupling portion could have the shape of a polygon, in particular an octagon. FIG. 8 illustrates a coupling portion in the shape of a toothed wheel. In FIGS. 9 to 11, the coupling portion is formed by at least two posts preferably equally spaced apart from each other. The coupling portions could also for example have the shape of at least one protuberance 30 as illustrated in FIGS. 12 and 13. According to a further embodiment the cavity of the base portion could be provided with coupling means which are complementary to the one of the coupling portion, so as to provide a coupling within this cavity.

Figure 14:
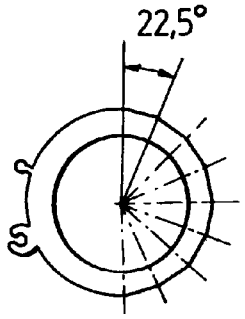
FIG. 14 shows an alternative for the shape of the base portion of the body according to the invention.

The outer surface of the base portion may also have different shapes. Generally, the outer surface of the respective base portions have the shape of a polygon. A cylindrical shape is considered in the present description and the appended claims as a particular polygon having an endless number of sides. According to an alternative, the polygon could have a determined number of sides. A combination of a rounded surface with a number of plane sides is also possible, such as illustrated in FIG. 14, showing a possible cross sectional view of the base portion having the shape of halve a circle and halve a polygon with 16 sides. If two such bodies are located as the second 17 and fourth 19 bodies in FIG. 4. The rotation movement of those two bodies will be a stepwise rotation movement, each step being equal to 22.5 degrees (360 degrees divided by 16).

Figure 15:
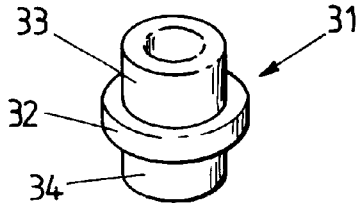
FIG. 15 shows a coupling member for coupling two coupling portions to each other.
Figure 16:
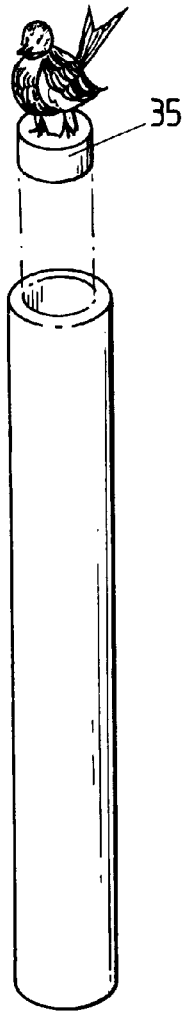
FIGS. 16 and 17 show other accessories fitting in the coupling portions.
Figure 17:
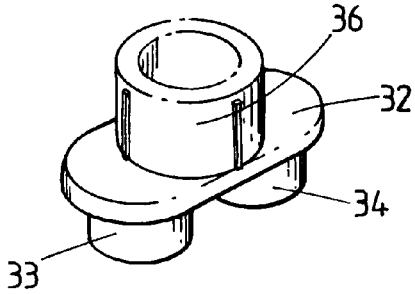

FIGS. 15 to 17 show examples of accessories for use in connection with the body according to the invention. In FIG.

15, a coupling member 31 is shown, formed by a base plate 32, at both sides of which a post 33, 34 extends. The posts 33, 34 are provided for fitting within the cavity of the coupling portion and have therefore a diameter substantially equal to the internal diameter of the coupling portion according to FIG. 2. This coupling member enables thus to connect a coupling portion from a first body to a coupling portion of a second body.

FIG. 16 shows another example of an accessory, having the shape of a cylinder and dimensioned for fitting in the cavity of the coupling portion according to FIG. 2. On top of the cylinder, an object holder 35, may be fitted in. A further object holder (not shown) provided for fitting in the coupling portion could also form an accessory.

Still another accessory is illustrated in FIG. 17, wherein the posts 33 and 34 are provided on a same side of the base plate 32. These posts are provided for fitting in two coupling members placed or assembled adjacent each other. A coupling post 36, having substantially the same shape and dimension as the coupling portion of FIG. 2, is applied on the other side of the base plate 32, so as to fit within the cavity of the base portion of a body 10.

In a preferred embodiment, the body according to the invention may be used as a cap for a recipient, in particular a bottle, or as a recipient itself. When used as a cap, the base portion forms then the cap to be fitted on the recipient. According to an alternative, the coupling portion forms the cap provided to be fitted on the recipient. The cavity of the cap may advantageously comprise internal threads (not shown) provided for cooperating with threads of a bottle neck. Use of the body according to the invention as a cap for a recipient provides an added value to the recipient.

In the described embodiments a cover portion 37 is provided between the base portion and the coupling portion, as illustrated in FIG. 2. Alternatively, the cover portion could be provided on top of the coupling portion (not shown). It is also conceivable to provide a body without cover portion. In that case, the body could not be used as a cap for a recipient, but can still be used as a toy.

Figure 18:
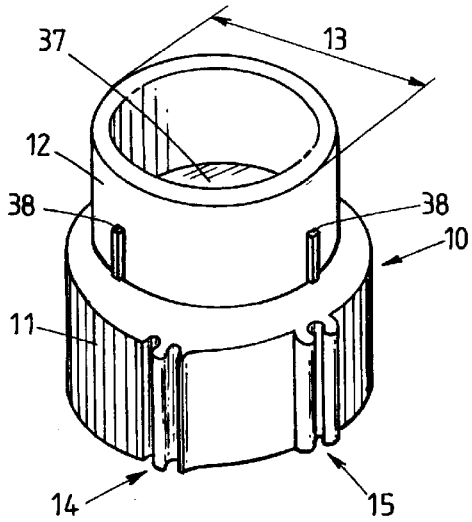
FIG. 18 shows, on an enlarged scale, a perspective view of a further embodiment of a body according to the invention.
Figure 19:
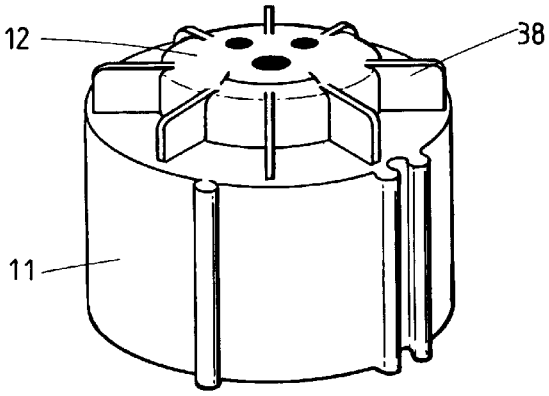
FIG. 19 is a perspective view of a further embodiment of a body according to the invention.

The coupling portions 12 may advantageously be provided with clamping members 38, as illustrated in FIG. 2, for partially clamping the free rotation of the coupling portion in the base portion of another body. According to a preferred embodiment, the clamping members could have a height which is approximately a halve of the coupling portion's height, as illustrated in FIG. 18. With this embodiment, the user can choose between a clamped position whereby the coupling portion of the body is totally inserted in the base portion of another body. A loose position is obtained when only the top halve portion of the coupling portion is inserted in the base portion of another body. The clamping members can have the shape as illustrated in FIGS. 2 and 18. According to another embodiment, the clamping members have an extended shape, as illustrated in FIG. 19. FIG. 20 shows several alternatives as to the height of the clamping members: they can be higher than the level of the coupling portion (FIG. 20*a*), at the same level (FIG. 20*b*) or lower (FIG. 20*c*).

Two bodies, in particular bottle caps, according to the invention, which are assembled adjacent each other, as illustrated in FIG. 2, form a building "brick". A plurality of such bricks may be assembled in different ways and still enable a rotation movement of one brick with respect to the other bodies or bricks. In such a manner, rounded wall structures may easily be formed by building a flat wall construction and rotating subsequently the bricks with respect to each other.

When used as a toy or building block, it forms thus an added value to the cap and contributes, due to its recuperation properties, to the preservation of the environment. Existing moulds for conventional caps may easily be adapted for moulding a body according to the invention instead of a conventional cap.

In the present description, a number of alternatives for the body according to the invention have been presented. It will be clear that when making a construction with bodies according to the invention, a combination of different bodies may be used, provided they may be mated to each other.

FIG. 25 is a top view on an alternative embodiment of two bodies according to the invention. The coupling portion 12 is cylindrical. The base portion 11 is squared within the space as defined according to FIG. 5 and cylindrical outside said space. In FIG. 26, a further embodiment is shown, wherein the base portion 11 is squared both within and outside the defined space. The bodies according to these alternatives do not allow stepwise rotation relative to each other, but allow a large number of configurations. Nevertheless they remain compatible with the other embodiments.

Two bodies according to FIG. 2 can be mated with each other through the intermediary of one or several connection bodies according to FIG. 27. This allows to form an elongated brick consisting of three or more bodies. Squared shaped connection bodies may be provided in connection with the bodies according to FIGS. 25 and 26.

As illustrated in FIG. 28, the base portion may have a corrugated shape, facilitating gripping of the body, enhancing the thermal isolation and allowing to position the bodies with respect to each other at the desired angle.

Figure 30:
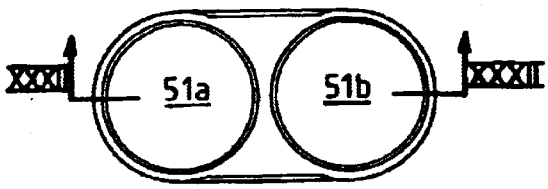
Figure 31:
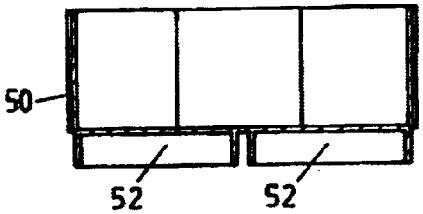
Figure 32:
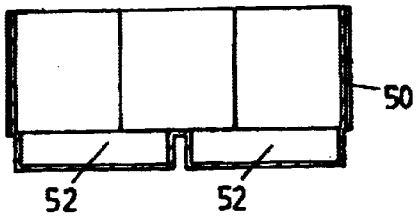

FIGS. 29 to 32 show a double shaped toy set or building block according to the present invention. The body 50 comprises two coupling portions 52 adjacent to each other. In the embodiment of FIG. 30 the base portion forms two separate containers 51*a* and 51*b* whereas in FIG. 29 only a single container 53 is formed. The upper border of the base portion is bend near the mid-section 54 in order to reinforce the border and enable a positioning of a further body.

FIGS. 33 and 34 show an embodiment of a toy set or building block according to the invention wherein a coupling ring 55 is applied within the base portion 11. As shown in FIG. 34 the coupling ring couples two bodies through mating their base portions 11, in order to form a closed container or a box. This coupling ring can be used as a support for an encryption, thus showing the upper side of the container.

LIST OF REFERENCES

PRIOR ART (FIG. 1)

1 first body
2 second body
3 third body
4 fourth body
5 detent
6 indent
7, 8 indents

INVENTION (FIGS. 2 to 34)

10 body
11 base portion
12 coupling portion
13 external diameter
14 male member
15 female member

16 first body
17 second body
18 third body
19 fourth body
20 fifth body
21 arrows
22 outer surface base portion
23 common tangent plane
24 common tangent plane
25 cavity
26 central axis of the base portion
27 central axis male member
28 virtual cylinder
29 post
30 protuberance
31 coupling member
32 base plate
33, 34 posts
35 object holder
36 coupling post
37 cover portion
38 clamping members
39 stopping member
50 body
51 (a+b) containers
52 coupling portion
54 mid-section
55 coupling ring

What is claimed is:

1. A toy set comprising at least a first (16), second (17), third (18) and fourth (19) body, each body being substantially equally dimensioned, wherein:

each of said bodies comprises a coupling portion (12) applied on a base portion (11), each base portion (11) has an outer surface (22) delimiting a substantially cylindrical shaped cavity (25), said first and second bodies (16, 17) are provided for being stacked upon each other, wherein said coupling portion (12) of said first (16) body rotatably fits within said cavity (25) of said second body (17), said third and fourth bodies (18, 19) are provided for being stacked upon each other, wherein said coupling portion (12) of said third body (18) rotatably fits within said cavity (25) of said fourth body (19), each of said bodies further comprises a male and a female connecting member (14, 15) which form protrusions extending outwardly from said outer surface (22) of the base portion (11) of the body, each of said male connecting members (14) of each of said first, second, third and fourth bodies is complementary to each of said female connecting members (15) of each of said first, second, third and fourth bodies, said first and third bodies (16, 18) are provided for being assembled adjacent each other, wherein said male connecting member (14) of said fist body (16) fits within said female connecting member (15) of said third body (18) and simultaneously said male connecting member (14) of said third body (18) fits within said female connecting member (15) of said first body (16), said second and fourth bodies (17, 19) are provided for being assembled adjacent each other, wherein said male connecting member (14) of said second body (17) fits within said female connecting member (15) of said fourth body (19) and simultaneously said male connecting member (14) of said fourth body (19) fits within said female connecting member (15) of said second body (17), said male and female connecting members (14, 15) of each of said bodies are located within a space delimited by said outer surface (22) of the base portion (11) of the body and two parallel tangent planes (23, 24) which are tangent to said outer surface (22) of the base portion (11) of the body.

2. The toy set according to claim 1, wherein said outer surface (22) is substantially polygonal at least outside said space and comprises at least three sides outside said space.

3. The toy set according to claim 1, wherein both said male and female members (14, 15) of each of said bodies form protrusions extending outwardly from said outer surface of said body, said male member (14) of said first body (16) being provided for being slidably mated with said female member (15) of said third body (18) and said female member (15) of said first body (16) being provided for being slidably mated with said male member (14) of said third body (18), said male member (14) of said second body (17) being provided for being slidably mated with said female member (15) of said fourth body (19) and said female member (15) of said second body (17) being provided for being slidably mated with said male member (14) of said fourth body (19).

4. The toy set according to claim 1, wherein said female member of each of said bodies is provided with a stopping member (39).

5. The toy set according to claim 1, wherein said outer surface (22) of each of said bodies comprises outside said space at least eight sides.

6. The toy set according to claim 1, wherein said outer surface is essentially cylindrical.

7. The toy set according to claim 1, wherein said male and female members (14, 15) of each of said bodies are located on said outer surface (22) within a segment not larger than 60 degrees of said outer surface (22).

8. The toy set according to claim 1, wherein said male and female members (14, 15) of each of said bodies are located on said outer surface (22) on a segment of at least 40 degrees of said outer surface (22).

9. The toy set of claim 1, further comprising a coupling member (31) comprising a base plate (32) on which at least two first coupling posts (33, 34) are provided, each of the first coupling posts being provided to fit within a cavity of said coupling portion (12) of said first, second, third or fourth body (16–19), said first coupling posts having a diameter substantially equal to an internal diameter of said coupling portion (12).

10. The toy set of claim 9, wherein the coupling member (31) further comprises a second coupling post (36) which is provided to fit within said cavity (25) of said base portion (11) of said first, second, third or fourth body (16–19), said coupling post having substantially the same shape and dimensions as said coupling portion (12).

11. The toy set of claim 1, further comprising an accessory having the shape of a cylinder and being dimensioned for fitting in a cavity of said coupling portion (12) of said first, second, third or fourth body (16–19), and an object holder (35) for fitting in said cylinder.

12. The toy set of claim 1, further comprising a double shaped body (50) comprising two coupling portions (52) adjacent to each other and a base portion, an upper border (54) of said base portion being bent for enabling positioning of a further body.

13. The toy set of claim 1, further comprising a coupling ring (55) for coupling two of said first, second, third and fourth bodies (16–19) through mating their base portions (11).

14. A first body (16) comprising:

a coupling portion (12) applied on a base portion (11), said base portion (11) having an outer surface (22) delimiting a substantially cylindrical shaped cavity (25), said cavity (25) having an internal diameter essentially equal to an external diameter of a virtual cylinder (28) which delimits said coupling portion (12), said first body (16) further comprising a male and a female connecting member (14, 15) which forms protrusions extending outwardly from said outer surface (22) of the base portion (11) of the body, said male connecting member (14) being complementary to said female connecting member (15), both said male and female connecting members (14, 15) being provided for assembling said first body adjacent a single further body (18), said male and female connecting members (14, 15) being located within a space delimited by said outer surface (22) of the base portion (11) of the body and two parallel tangent planes (23, 24) which are tangent to said outer surface (22) of the base portion (11) of the body.

15. The first body according to claim 14, further comprising a cover portion (37) between said base portion and said coupling portion.

16. The first body according to claim 14, further comprising a cover portion on top of said coupling portion.

17. The first body according to claim 14, wherein said coupling portion is hollow.

18. The first body according to claim 14, wherein said coupling portion of said body comprises clamping members (38) extending outwardly from said coupling portion and equally spaced apart on the outer surface (22) of the coupling portion.

19. The first body according to claim 14, wherein said coupling portion is formed by at least two posts, said posts extending essentially parallel to said outer surface and being delimited by a virtual cylinder having a diameter essentially equal to said substantially cylindrical shaped cavity.

20. The first body according to claim 14, wherein said coupling portion is formed by at least one elongated protuberance, said protuberance extending essentially parallel to said outer surface and being delimited by a virtual cylinder having a diameter essentially equal to said substantially cylindrical shaped cavity.

21. The first body (16) according to claim 14, wherein said body is a cap for a recipient.

22. The first body (16) according to claim 14, wherein said body is a recipient.

* * * * *